US005118218A

United States Patent [19]

Musser et al.

[11] Patent Number: 5,118,218

[45] Date of Patent: Jun. 2, 1992

[54] BOX CULVERT WITHOUT RIB STIFFENERS

[75] Inventors: Samuel C. Musser, Sandy; Donald J. Cier, Salt Lake City, both of Utah

[73] Assignee: Syro Steel Company, Centerville, Utah

[21] Appl. No.: 719,392

[22] Filed: Jun. 24, 1991

[51] Int. Cl.[5] ..... E01F 5/00

[52] U.S. Cl. ..... 405/124; 405/150.1

[58] Field of Search ..... 405/124, 125, 126, 150, 405/151, 153, 288; 138/121, 173

[56] References Cited

U.S. PATENT DOCUMENTS

| | | | |
|---|---|---|---|
| 3,638,434 | 2/1972 | DeLaere | 405/126 |
| 4,141,666 | 2/1979 | DeGraff | 405/126 |
| 4,211,504 | 7/1980 | Sivachenko | 405/124 X |
| 4,318,635 | 3/1982 | Gurtner et al. | 405/126 |
| 4,650,369 | 3/1987 | Thomas et al. | 405/126 |

*Primary Examiner*—David H. Corbin

*Attorney, Agent, or Firm*—Trask, Britt & Rossa

[57] ABSTRACT

A corrugated box culvert constructed from reinforced corrugated steel or aluminum sheets having very deep corrugations and generally having a uniform bending moment profile for the whole length of the culvert.

18 Claims, 6 Drawing Sheets

BOX CULVERT WITHOUT RIB STIFFENERS

BACKGROUND OF THE INVENTION

1. Field

The instant invention relates to box culverts constructed of corrugated metal, especially steel and aluminum.

2. State of the Art

Box culverts are drainage structures fabricated from structural plate steel or aluminum wherein the culvert has a large width-to-height (span-to-rise) ratio. Corrugated metal box culverts approach the shape of a low, wide box. Corrugated metal sheets of shallow corrugation with the side sheets having the corrugations running vertically have been conventionally used for box culvert construction.

The shape of a box culvert has generally been dictated by its use, namely in situations where a roadway height above a stream bed, for example, was minimal, yet the culvert opening had to accommodate at least periodic flows of large volumes of water. Box culverts generally have dirt fill around their exterior surface with a minimal amount of fill above the culvert. In a true arch construction, the shape of the arch may deflect load from a roadbed above the culvert into the soil along the sides of the culvert. However, because of the width-to-height ratios, box culverts do not have the advantages of "true arch" construction. Also, because of the lack of stiffness in the sheet metal used in such box culverts, the primary support has been provided by the stiffening ribs, as illustrated in FIG. 1 and in U.S. Pat. No. 4,141,666 of DeGraff issued Feb. 27, 1974.

Box culverts traditionally have had a relatively flat top, typically having the shape shown in FIG. 1, labelled "Prior Art Box Culvert." Such a shape has necessitated the use of supplemental reinforcing members to support the top and sides of traditional box culverts.

In FIG. 1, corrugated metal plates were joined together to form the sidewalls 10, the roof 11 and corners 12 of a typical box culvert. Supplemental stiffening members or ribs 13 of thick cross-section and formed to have the predesigned cross-sectional shape of the box culvert were spaced along the length of the culvert to give the culvert the necessary strength to accept the magnitude and direction of applied loads. These supplemental ribs require field erection.

Cross-sections of rib stiffeners and typical haunch and crown stiffening members 13, often referred to as "ribs," are illustrated in FIGS. 2 and 3. Haunch ribs are located along the sides of the culvert while crown ribs are located over the top of the culvert. These particular ribs have been used especially with box culverts constructed from corrugated aluminum sheets. The shape and length of stiffening ribs render them inflexible. They are preformed to a particular length and curvature. Generally, one type of haunch rib can be adapted to several sizes (widths and heights) of box culverts since the same curved corner (same radius and radians) is present.

The necessity of supplemental stiffeners generally complicates erection of box culvert structures in the field, requiring additional time and labor. The metal sheets must be bolted together to form the basic structure, then the ribs must be bolted in place, using many bolts per rib, to form a rigid structure. The number of ribs per unit length must be increased as the width of a box culvert increases. When the width (span) and height (rise) increase to an extent that the shape (curvature) or length of arc of the corner changes, the shape and size of the rib also changes. Thus, a variety of ribs must be made, in order-to accommodate a wide variety of box culvert widths and heights.

While the structure illustrated in FIGS. 1–3 are typical for corrugated aluminum, corrugated steel structures are similarly constructed, i.e., from corrugated steel sheets and stiffener ribs. Stiffening ribs of steel may have a cross-section different than those shown in FIGS. 2 and 3, for example, angle iron may be used, however, a generally "L"-shaped cross-section is typical.

The structure illustrated in FIGS. 1 through 3 are similar to those contained in U.S. Pat. No. 4,141,666 of DeGraff which describes elongated stringers which run the length of the culvert and curved stiffening ribs. This reinforced structure was designed to replace low-headroom culverts having floors tying the lower edges of the culvert sidewalls together.

The structure illustrated in the DeGraff patent is particularly well suited for corrugated aluminum sheets. The patent indicates at column 4, lines 13, et seq. certain preferred aluminum alloys. While the DeGraff structure may function as desired, the structure requires considerable field erection and specialized reinforcement members.

While both aluminum and steel sheets with standard corrugations, respectively about $2\frac{1}{2}''\times 9''$ and $2''\times 6''$ corrugations, have been used in conjunction with stiffeners to form the box culverts, specially corrugated, thick steel sheets have been used to form box culverts of the shape illustrated in FIG. 4 (prior art structure) without any stiffening ribs. The corrugated sheet steel has deep, approximately 5", corrugations with 15 inch spacing (pitch). The corner is sharp, i.e. a substantially square corner. Such a structure requires that the side sheet members be welded to the roof members. Such a structure has not required stiffening ribs; however, it has a bending moment profile of a less desirable shape (shown in dotted lines on FIG. 4), which has discouraged widespread use of such structures.

The shape of the culvert in FIG. 4 generally requires that the sidewalls of the culvert support loads applied to the roof without the benefit of much soil support.

A prior art box culvert structure employing stiffener ribs and stringers is illustrated and described in U.S Pat. No. 4,141,666.

SUMMARY OF THE INVENTION

The instant invention comprises a box culvert structured of deeply corrugated metal sheets which generally, with soil support, can be formed into a culvert having a width significantly greater than its height without the necessity of added rib stiffeners, welded corners, or sharp corners and the like.

The box culvert of the instant invention has a pair of opposed, substantially linear sidewalls constructed of corrugated sheets having their corrugations oriented substantially vertically. The corrugated sheets have sufficient thickness in conjunction with corrugations of sufficient depth and spacing to provide sufficient rigidity and strength to be formed into a curvilinear box culvert shape having rounded corners joining an essentially flattopped roof with opposed, substantially vertical sidewalls. The depth and pitch of the corrugations are significantly greater than has been previously used in box culverts with rounded corners.

The box culvert invention described herein involves reduced field erection and the absence of specially formed ribs or stiffeners in comparison with the prior art culverts depicted in FIGS. 1–3. Also, the bending moment profile of the instant invention has a more desirable shape than that of the sharp-cornered structure illustrated in FIG. 4.

DETAILED DESCRIPTION OF THE INVENTION

The instant invention comprises a unique, unreinforced structure for box culverts with curved corners having a width (span) which greatly exceeds the height (rise) of the culvert. Such culverts are formed from corrugated metal sheets having deep vertical corrugations and sufficient wall thickness wherein additional stiffening members are not required.

Figure 5:
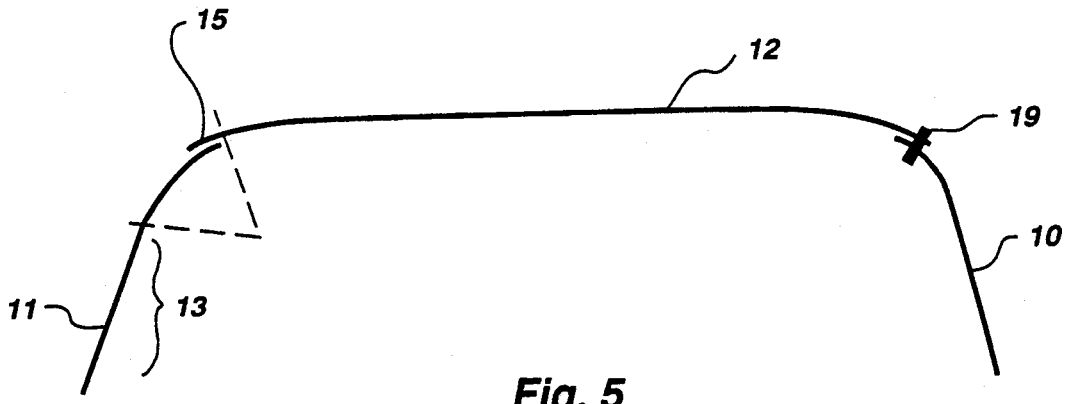
FIG. 5 is an elevational view a box culvert of the invention.

Further description of the invention may be facilitated by reference to the attached figures. FIG. 5 is an elevational view of a box culvert having a width which is about two to three times its height. The box culvert of this invention may be up to about 20 feet or more in width (span) with a height (rise) of up to about 10 feet. Corrugated box culverts of this invention, as well as conventional rib-stiffened box culverts are designed for low, wide openings with periodic large water flow requirements. Box culvert heights (rises) of from between about 1½ to about 5 feet are typical. The rise may be greater, however, a more conventional arch-type culvert will generally be utilized when the span-to-rise ratio requirement is not restricted.

The box culvert illustrated in FIG. 5 is unique inasmuch as the structure is made from deeply corrugated metal sheets which do not require additional stiffening ribs. The corrugations of the sidewall members 10 and 11 run vertically. The roof member 12 is also made from the same type of metal sheet with deep corrugations which nest into those of the sidewall members 10 and 11. Sidewall members 10 and 11 are preferably inclined inwardly towards one another at a slight angle from the vertical, i.e., the span is greater at the base of the vertical members than at their top. The sidewalls comprise a lower foundation engaging section 13 which is essentially linear and a corner portion 14 which is a curved or curvilinear portion. The roof member 12 has a slightly curved margin portion 15 which overlaps the free end of the curved portions 14 of sidewalls 10 and 11.

The roof member 12 is, similarly to the sidewall members, composed of a number of sheets of corrugated metal bolted together to form an essentially flat roof. Typically, there is a slight curvature (large radius) to the roof member and as illustrated in FIG. 5, the marginal edges of the roof may be slightly curved to match somewhat the curvature of upper portion of the sidewalls to overlap and to be bolted to the sidewall members.

Sidewall members do not generally require more than one vertical sheet. It is typical that each sidewall metal sheet is a single sheet which has been formed to have a curved end portion and a bottom edge which is supported by the foundation for the culvert. The sidewall of the culvert is formed by bolting by means of bolts individual vertical sheets together in a side-by-side manner.

Culverts of various types, including rib-reinforced box culverts are typically constructed from corrugated galvanized steel or aluminum which has a 6×2 corrugation, which is nominally a two-inch deep (amplitude) corrugation with a six inch spacing (pitch). The corrugated sheets of the instant invention used to construct unreinforced box culverts have a minimum corrugation depth of about four inches and typically a depth (amplitude) from about five to six inches. The spacing of the corrugations (pitch) is generally from about 12 to 21 inches, although preferably from about 14 to 16 inches. The wall thickness of such deeply corrugated sheets is from about ⅛" to ⅜", in contrast to aluminum or steel with shallow corrugations. The deeply corrugated steel sheets preferred for use on the instant invention typically have a width of about 1.5 ft. to about 3.5 ft. and a length of about 5 ft. to about 25 ft. with a 2.5 ft. by 15 ft. sheet being preferred.

The unreinforced box culvert illustrated in FIG. 5 typically has a width (span) of from about 5 feet to about 20 feet or more. The roof is quite flat, for example, a roof member having a width of about 10 to 12 feet, may have a crown of only about three to four inches in height. The roof member may be formed about a very large radius, for example, a 10 foot wide roof member may have a radius of curvature of about 20 to 30 feet. Roof structures may require two or more individual steel sheets.

Figure 6:
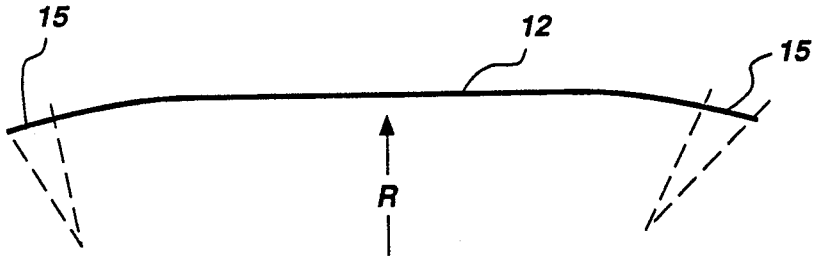
FIG. 6 is an elevational view of a roof member of a box culvert of the instant invention.

As shown in FIG. 6, the outer lateral margins 15 of the roof are curved to a shorter radius than the central portion of the roof. There are some instances where it would be preferable to form an extreme curvature to the upper portion of the sidewall member so as to cause the curvature of the sidewall member corner to be in a tangential position with the essentially flat surfaces of the roof member, thus eliminating the need to bend the outer margins of the roof member. Curving the marginal edges of the roof to about the same radius as the radius of the corner or upper portion of the sidewall member may facilitate the joining together of the sidewall and the roof members.

Figure 7:
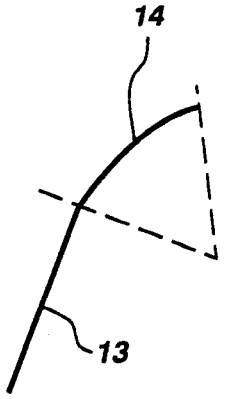
FIG. 7 is an elevational view of a side member of the box culvert of the instant invention.

A typical sidewall member is illustrated in FIG. 7. The lower portion of the sidewall 13 is essentially a linear portion 14 which extends into a curved portion which is curved over a radius of about three feet. Cold bending heavy gauge, deeply corrugated sheet metal from mild steel to a radius of less than three feet may result in such extreme cold working (case hardening) conditions that the steel may become too brittle and suffer microcracks or even open fissures. Cold bending is frequently done by a process called "bumping," which involves feeding an end of the corrugated sheet metal into a press with a curved die while striking it with a mechanical or hydraulic ram from above to cause the sheet to conform to the curvature of the die. The die ram conforms to the corrugation of the sheet metal.

Cold bending results in case hardening of sheet steel, which increases its strength but reduces its toughness (ductility). It can result in fissures in the curved steel if the radius of curvature is too small. Since the upper portion (curved corner) of the sidewall member is subjected to compressive, shear and bending forces it is advantageous that the corner is strengthened by case hardening, provided that the radius of curvature is large enough to prevent fissuring or microcracking of the metal. Aluminum sheet metal of a thickness and corrugation depth comparable to deeply corrugated sheet steel may be more easily bent to the same radius of curvature inasmuch as aluminum has a lower elastic modulus than steel; however, the strength of such curved, corrugated aluminum is much weaker than the sheet steel. Aluminum also provides less ductility than steel.

Both corrugated sheet steel and aluminum may be heat formed to a curved condition in which radii of curvature may be less than three feet. Neither steel nor aluminum case harden when bent while hot.

For structural reasons a radius of curvature of less than about two feet is usually not required. The curved portion of the deeply corrugated steel sheets may be bent over an arc from about 30 degrees up to about 90 degrees. The sidewall members are usually inclined from the vertical such that the linear lower portion is at an inclination of about five to ten degrees from the vertical towards the roof member, i.e. towards each other.

Figure 8:
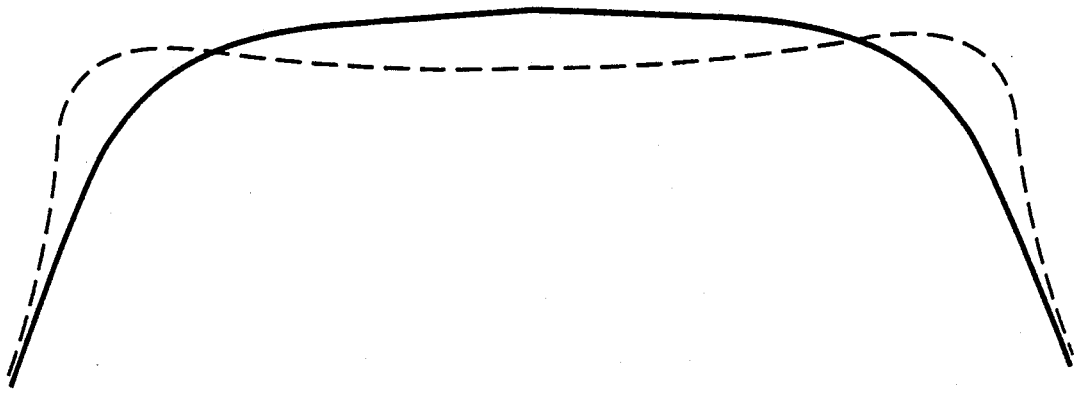
FIG. 8 is an elevational view of a box culvert of the instant invention with a superimposed bending moment profile.

A typical bending moment profile is illustrated in FIG. 8 for the unreinforced box culvert structure of the instant invention. The elevational view of the box culvert is illustrated with the bending moment profile being shown in dashed lines. The bending moment profile of FIG. 8 is to be contrasted with the bending moment profile of FIG. 4. The structure of FIG. 4, i.e., a sharp, non-rounded corner, is a conventional technique of making box culverts from deeply corrugated thick metal sheets. Also, in contrast to box culverts having longitudinally spaced ribs, i.e. stiffening members, the bending moment profile of the reinforced box culverts of the instant invention is essentially uniform over the entire length of the culvert. The bending moment profile illustrated in FIG. 8 will be the same for the culverts of the instant invention regardless of the cross-sectional plane taken along its length.

Figure 1:
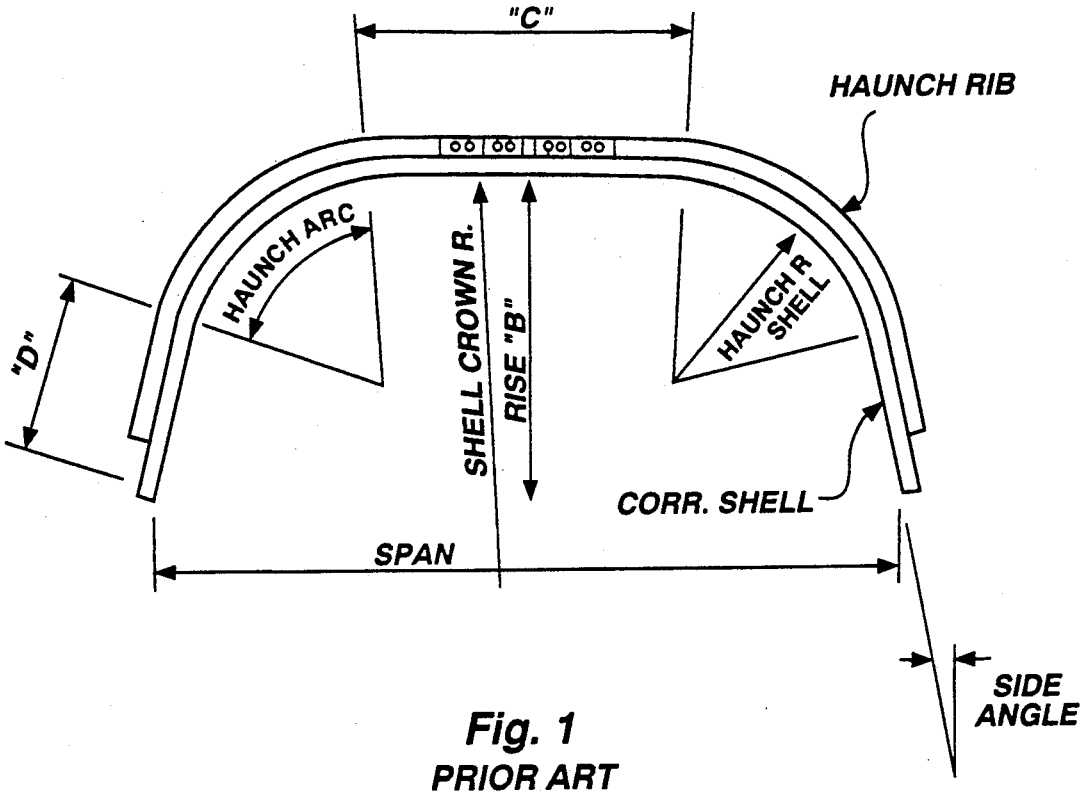
Fig. 1 PRIOR ART
FIG. 1 is a cross-sectional elevational view of a prior art box culvert having overlaid stiffening ribs.
Figure 2:
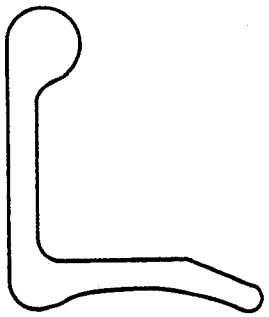
Fig. 2 PRIOR ART
FIG. 2 is a cross-sectional view of an aluminum rib used for stiffening a box culvert structure such as that illustrated in FIG. 1.
Figure 3:
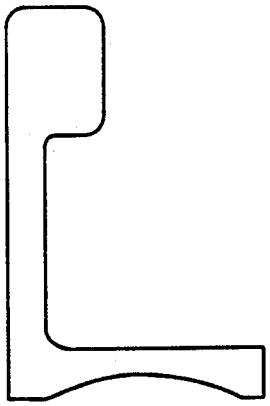
Fig. 3 PRIOR ART
FIG. 3 is a cross-sectional view of an alternative stiffening rib.
Figure 4:
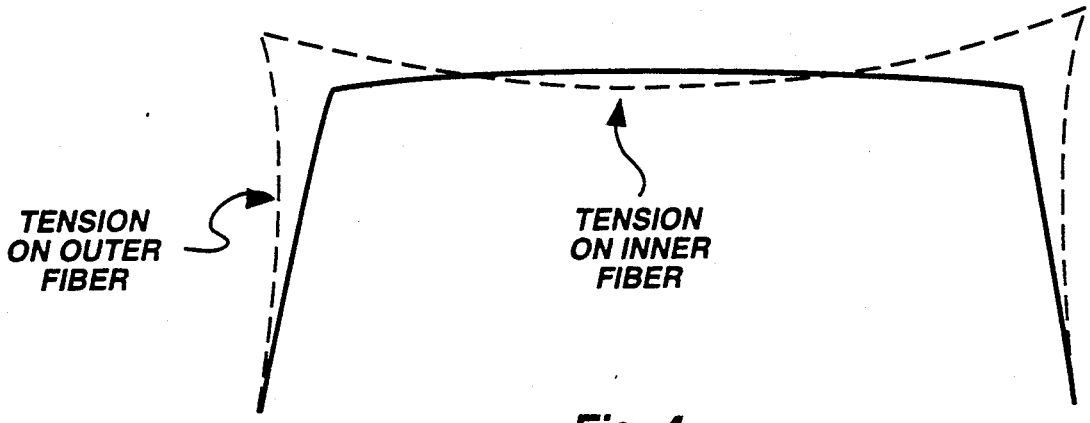
Fig. 4 PRIOR ART
FIG. 4 is an elevational view of a prior art structure constructed of deeply corrugated galvanized steel sheet members and a superimposed bending moment profile.

The rounded corner design illustrated in FIG. 8 decreases the maximum bending moment in comparison to the sharp-corner design of FIG. 4. The general nature of the moment pattern is the same for all metal boxes. That is, tension occurs on the inner fibers at the crown and compression on the inner fibers at the haunch (the curved portion and lower sidewall portion of the culvert). The position and shape of the bending moment profile with respect to the culvert is an indication of the magnitude of the bending moment at any particular location on the culvert structure.

Figure 9:
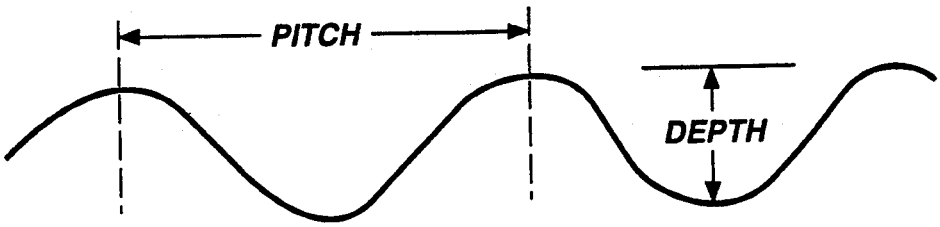
FIG. 9 is a cross-sectional view of the deeply corrugated steel sheet utilized in the box culverts of the instant invention.

A cross-sectional view of the corrugated sheet metal utilizing the instant invention is illustrated in FIG. 9. Typically such sheet metal is mild steel, particularly galvanized sheet steel with a thickness of about $\frac{1}{8}''$ to about $\frac{3}{8}''$ and corrugations of a depth of from about four inches to about six inches with corrugation depths of about 5 to $5\frac{1}{2}$ inches and a pitch of about 15 inches generally being preferred. One source of such deeply corrugated sheet metal is Syro Steel which markets deeply corrugated galvanized steel sheets under the trademark "DEEP COR."

Figure 10:
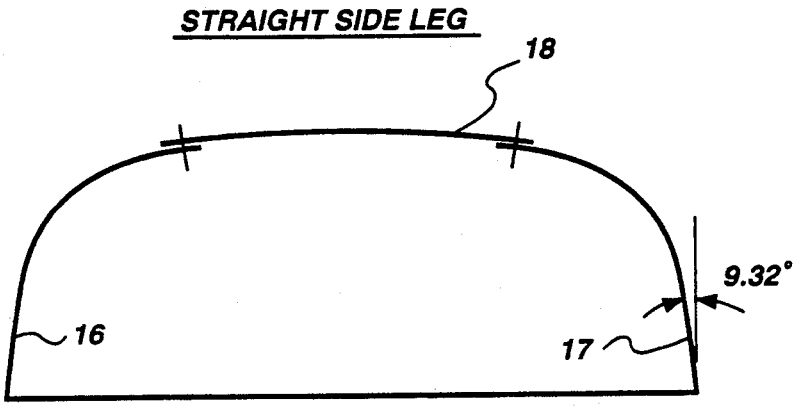
FIG. 10 is a cross-sectional elevational view of a box culvert of the invention having opposed side members of differing overall lengths.
Figure 11:
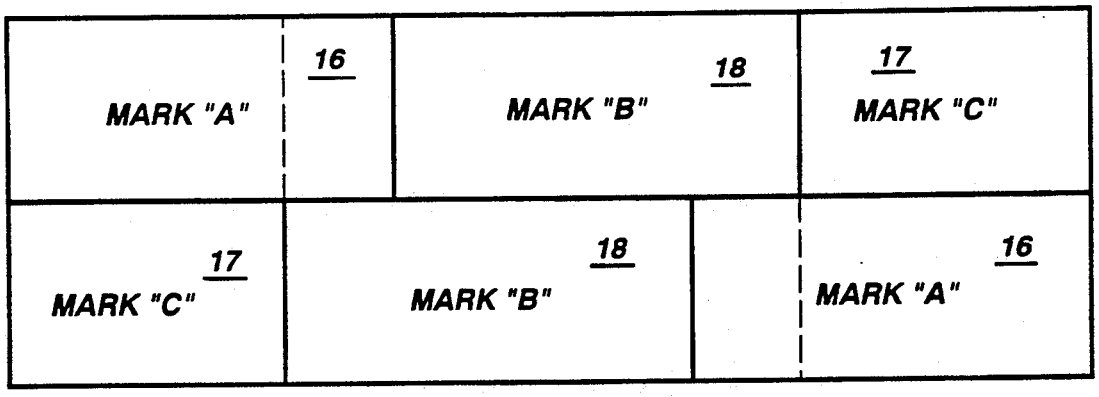
FIG. 11 is a plan view of the box culvert of FIG. 10.

The culvert illustrated in FIGS. 10 and 11 has an offset construction wherein opposed side members have different overall heights so that the crown members, which are always the same length, are offset from one another such that the geometric center of a crown member panel is not on the central longitudinal axis of the culvert.

The left sidewall plate 16 in FIG. 10 (plate "Mark A") has a different overall length than right sidewall plate 17. The roof member 18 is the same length, however, adjacent roof plates (Mark "B") are offset so that their geometric center is not along the central longitudinal axis of the culvert. The corrugations of the sidewall members run vertically and laterally across the roof member. Adjacent plates are overcapped and bolted together to form a single unit.

Figure 12A:
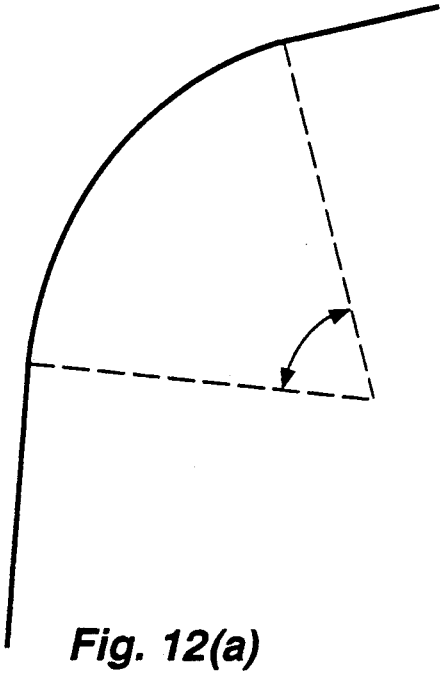
FIGS. 12(*a*), 12(*b*) and 12(*c*) are elevational, edge views of shaped metal sheets used in construction of the instant invention.
Figure 12B:
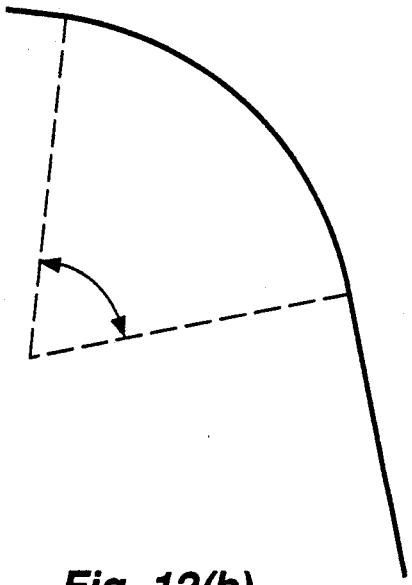
Figure 12C:
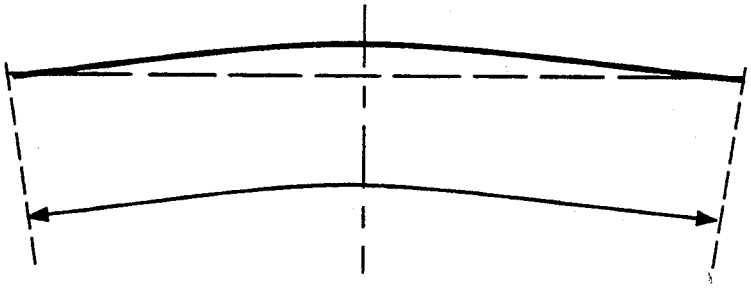

The shape of plates 16, 17 and 18 are illustrated in more detail in FIGS. 12(*a*), 12(*b*) and 12(*c*). The shape of plates 16, 17 and 18 are illustrated in more detail in FIGS. 12(*a*), 12(*b*) and 12(*c*), respectively. FIG. 12(*a*) depicts a single plate serving as both the side member and a portion of the crown member. And, FIG. 12(*c*) depicts a plate serving as a portion of the crown member. Together these three plates make up the complete circumference of the structure.

While the invention is described herein as being particularly effective for steel construction, other structural metal sheets in deeply corrugated form may be utilized, e.g., aluminum, titanium, bronze and the like, although galvanized steel and aluminum are the more commonly used metals.

What is claimed is:

1. A box culvert constructed from unreinforced corrugated metal sheets consisting essentially of:

a pair of opposed, unreinforced, substantially linear sidewalls constructed of corrugated structural metal sheets having corrugations which run substantially vertically and are from about 4" to 6" deep with a pitch spacing between adjacent corrugations of from about 12" to about 18", said sidewalls having a lower edge structured to interact with a foundation and an upper margin portion structured to interact with a roof member, said upper margin portion curved inwardly over and included angle of from about 30° to 90° with a radius of curvature of from about 2 ft. to about 4 ft.;

an unreinforced roof member constructed of corrugated structural metal sheets having corrugations which are of the same depth and periodic spacing as said sidewalls, said roof member having a central portion which spans a predominant portion of the width of said culvert, said central portion being substantially linear, said roof member having curved lateral edge margin portions which overlap said curved upper margin portions of said sidewalls; and fastening means for fastening the overlapping edge portions of said roof member to said upper curved portions of said sidewalls.

2. The box culvert of claim 1, wherein said corrugated sheets have a corrugation depth from about 5" to 5½" and a pitch spacing of from about 15" to 16".

3. The box culvert of claim 1, wherein said roof member has lateral edge portions having a curvature of substantially the same radius as said sidewall upper portions and curved over an included angle of about 5° to about 30°.

4. The box culvert of claim 3, wherein said included angle of the curved lateral edge portions of said roof members is from about 5° to about 15°.

5. The box culvert of claim 1, wherein said opposed sidewalls are inclined toward one another.

6. The box culvert of claim 1, wherein said sidewall upper margin portions are curved over an included angle of from about 50° to about 80°.

7. The box culvert of claim 1, wherein a tangent to the curved upper margin portion adjacent the upper edge of said sidewall is substantially horizontal.

8. The box culvert of claim 1, wherein a tangent to the curved upper margin portion adjacent the upper edge of said sidewall is at an angle of about 0°) to about 30° to the horizontal.

9. The box culvert of claim 5, wherein said sidewalls are each inclined at an angle of greater than 0° to about 10° to the vertical.

10. The box culvert of claim 1, wherein the distance between opposed sidewalls at the lower edge of each sidewall span is at least about 10 ft.

11. The box culvert of claim 1, wherein the culvert has a span-to-rise ratio of from about 2:1 to about 3.5:1, said rise being the vertical distance between the lower edge of said sidewall and the crown of said roof member.

12. The box culvert of claim 1, wherein said fastening means is bolts.

13. The box culvert of claim 1, wherein said fastening means is welds.

14. The box culvert of claim 1, wherein said culvert has a bending moment profile as illustrated in FIG. 5.

15. A box culvert of claim 1, wherein the bending moment profile is substantially uniform over the entire length of the culvert.

16. The box culvert of claim 1, wherein said culvert is fabricated from corrugated aluminum or galvanized steel sheet or plate.

17. The box culvert of claim 1 wherein the central portion of said roof member has an arch of less than about 4".

18. The box culvert of claim 1 wherein the central portion of said roof member has a radius of curvature of at least twice the length of the span of the box culvert.

* * * * *